US008845139B2

(12) United States Patent
Shin et al.

(10) Patent No.: US 8,845,139 B2
(45) Date of Patent: Sep. 30, 2014

(54) BACKLIGHT ASSEMBLY

(75) Inventors: Dong-Lyoul Shin, Suwon-si (KR); Hirokazu Shibata, Asan-si (KR); Jae-Chang Choi, Yongin-si (KR)

(73) Assignee: Samsung Display Co., Ltd. (KR)

( * ) Notice: Subject to any disclaimer, the term of this patent is extended or adjusted under 35 U.S.C. 154(b) by 260 days.

(21) Appl. No.: 13/356,756

(22) Filed: Jan. 24, 2012

(65) Prior Publication Data

US 2012/0188793 A1 Jul. 26, 2012

(30) Foreign Application Priority Data

Jan. 24, 2011 (KR) ..... 10-2011-0006687

(51) Int. Cl.
*F21V 29/00* (2006.01)

(52) U.S. Cl.
USPC ..... 362/294; 362/218; 362/373

(58) Field of Classification Search
USPC ..... 362/101, 217.11, 217.15, 218, 294, 362/373, 632, 633
See application file for complete search history.

(56) References Cited

U.S. PATENT DOCUMENTS

| | | | | |
|---|---|---|---|---|
| 6,880,947 | B2 * | 4/2005 | Hsieh et al. | 362/632 |
| 7,338,194 | B2 * | 3/2008 | Chen | 362/373 |
| 2005/0145374 | A1 * | 7/2005 | Dussinger et al. | 165/104.26 |
| 2008/0043478 | A1 * | 2/2008 | Wang | 362/294 |

* cited by examiner

*Primary Examiner* — Y My Quach Lee
(74) *Attorney, Agent, or Firm* — Cantor Colburn LLP

(57) ABSTRACT

A backlight assembly includes a light emitting module and a receiving container. The receiving container receives the light emitting module, and includes a first frame, a second frame and a heat dissipation channel. The first frame includes a first bottom, and first sidewalls connected to the first bottom. The second frame includes a second bottom which faces the first bottom and is sealed with the first frame. The first and second bottoms are spaced apart from each other and form the heat dissipation channel therebetween.

19 Claims, 10 Drawing Sheets

BACKLIGHT ASSEMBLY

CROSS REFERENCE TO RELATED APPLICATION

This application claims priority under 35 U.S.C. §119 to Korean Patent Application No. 2011-0006687, filed on Jan. 24, 2011 in the Korean Intellectual Property Office (KIPO), the contents of which are herein incorporated by reference in their entireties.

BACKGROUND OF THE INVENTION

1. Field of the Invention

The invention relates to a backlight assembly. More particularly, the invention relates to a backlight assembly used for a display apparatus and maximizing heat dissipation efficiency.

2. Description of the Related Art

Generally, a display apparatus includes a display panel displaying an image, a backlight assembly providing light to the display panel, and a driving part providing driving and/or control signals to each of the display panel and backlight assembly. The display panel may include a liquid crystal as a display element, and the liquid crystal may display the image by controlling a transmittance of the light provided from the backlight assembly.

The backlight assembly includes a light emitting module actually generating the light, and a receiving container receiving the light emitting module. The backlight assembly further includes a plurality of optical elements for efficiently providing the display panel with the light generated from the light emitting module. Light emitting diodes ("LED") are mainly used as a light source to maximize heat dissipation efficiency with relatively low power consumption. Since the number of the LEDs is substantially proportional to luminance of the backlight assembly, the number of the LEDs may be increased to enhance the luminance.

However, as the number of the LEDs is increased, heat may occur due to the light generated from the LEDs, and/or a current provided to the LEDs. The display element of the display apparatus is deteriorated due to an increase of a temperature of the display apparatus by the heat, so that display quality may be decreased, and the light emitting module may be damaged by the heat. Particularly, in case of using a structure that many LEDs are disposed in a particular area, for example, an edge-illumination type light emitting module, the heat is concentrated on the particular area, so that the display element may be easily deteriorated or the light emitting module may be easily damaged. Accordingly, the display apparatus needs heat dissipation means for dissipating or minimizing the heat generated from the light emitting module.

Heat dissipation characteristic may be the more enhanced as thermal conductivity of material forming the receiving container is increased. However, the receiving container should have high thermal conductivity thin thickness and light weight, so that the material forming the receiving container may be limited.

BRIEF SUMMARY OF THE INVENTION

The invention provides a backlight assembly maximizing heat dissipation characteristic regardless of thermal conductivity of a material forming a receiving container.

According to an example embodiment, a backlight assembly includes a light emitting module and a receiving container. The receiving container receives the light emitting module, and includes a first frame, a second frame and a heat dissipation channel. The first frame includes a first bottom, and first sidewalls connected to the first bottom. The second frame includes a second bottom facing the first bottom of the first frame, and connected to the first frame. The first and second bottoms are spaced apart from each other to form the heat dissipation channel therebetween.

In an example embodiment, at least one of the first and second bottoms may include boundary portions disposed along a first direction, extending along a second direction different from the first direction, and protruding toward the heat dissipation channel. The heat dissipation channel may be divided into a plurality of subspaces by the boundary portions respectively, and the subspaces are spaced apart from each other along the first direction.

In an example embodiment, the receiving container may further include a refrigerant and a channel layer. The refrigerant may partially fill each of the subspaces. The channel layer may be in each of the subspaces of the heat dissipation channel and on at least one surface of the first and second bottoms furthest away from the other bottom, and may move the refrigerant using a capillary pressure. In addition, the channel layer may include a metal layer having a groove pattern, sintered metal particles, or a mesh pattern on a surface of the metal layer.

In an example embodiment, the receiving container may further include a refrigerant which partially fills each of the subspaces, and a groove pattern, sintered metal particles, or a mesh pattern in each of the subspaces of the heat dissipation channel and on at least one surface of the first and second bottoms furthest from the other bottom to move the refrigerant using a capillary pressure.

In an example embodiment, the receiving container may further include a graphite which partially fills each of the subspaces.

In an example embodiment, the second direction may be inclined with respect to the first direction by about 45° to about 90°.

In an example embodiment, at least one of the first bottom and the second bottom may include first and second boundary portions. The first boundary portions may be arranged along a first direction, extend along a second direction different from the first direction, and be protruded toward the heat dissipation channel. The second boundary portions may extend along the first direction to be partially connected to the first boundary portions, and be protruded toward the heat dissipation channel. In addition, the heat dissipation channel may have a zigzag shape circulation space, and includes subspaces divided along the first direction by the first boundary portions and may be connected by the second boundary portions to form the zigzag shape circulation space. The receiving container may further include a refrigerant and a circulation pump in the heat dissipation channel.

In an example embodiment, the light emitting module may include a plurality of light emitting diodes disposed in a line, and facing at least one of the first sidewalls.

In an example embodiment, the second frame may include second sidewalls making contact with the first sidewalls, and connected to the second bottom.

According to the example embodiments, a heat dissipation channel in a receiving container is formed solely by combining first and second frames with each other, so that thickness of a display apparatus may be decreased because an additional dissipating means is not needed in the receiving container. In addition, a refrigerant and a first channel layer, or a graphite may be used in the heat dissipation channel, so that a thermal conductivity of the receiving container may be improved closer to the thermal conductivity of a superconductor. Thus, heat dissipation may be increased regardless of a thermal conductivity range of a material included in the receiving container.

BRIEF DESCRIPTION OF THE DRAWINGS

The above and other features of the invention will become more apparent by describing in detailed example embodiments thereof with reference to the accompanying drawings, in which.

DETAILED DESCRIPTION OF THE INVENTION

Figure 1:
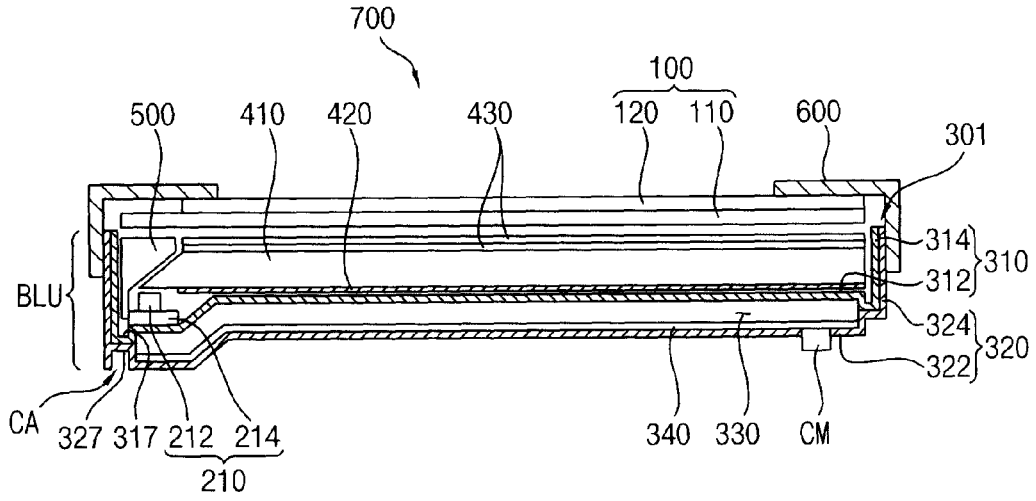
FIG. 1 is a cross-sectional view of an example embodiment of a display apparatus according to the invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, connected may refer to elements being physically and/or electrically connected to each other. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention will be explained in detail with reference to the accompanying drawings.

FIG. 1 is a cross-sectional view of an example embodiment of a display apparatus according to the invention.

Figure 2:
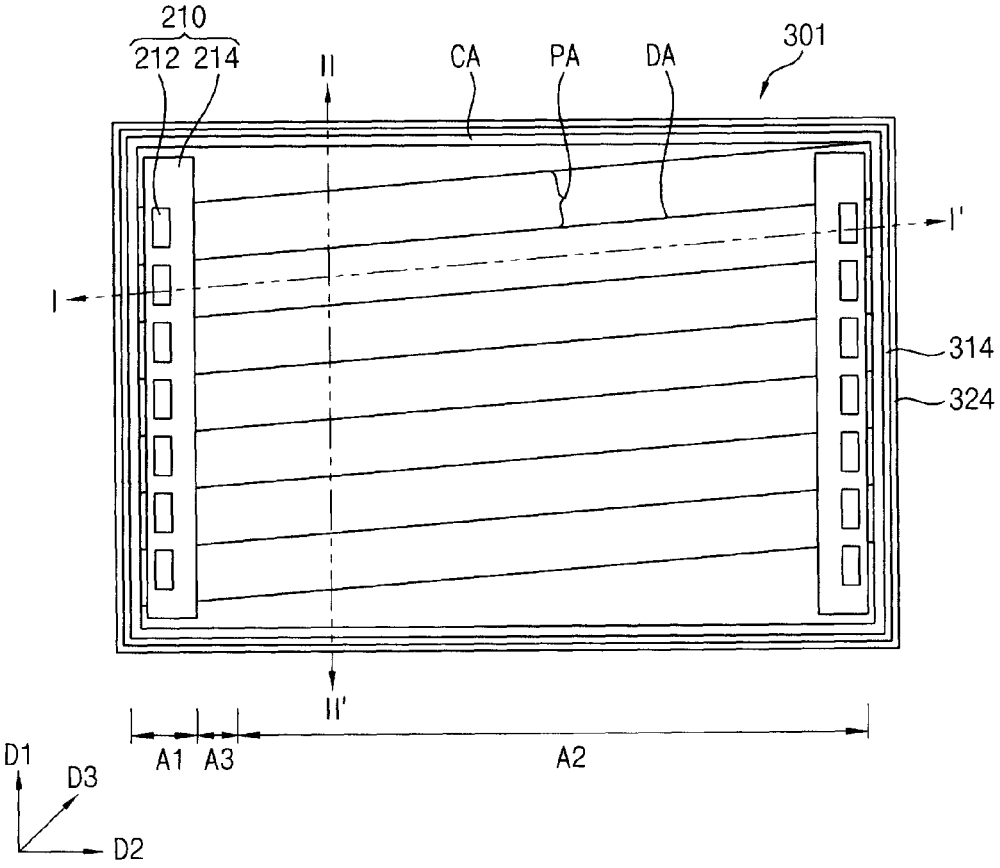
FIG. 2 is a plan view illustrating an example embodiment of a receiving container of FIG. 1.

FIG. 2 is a plan view illustrating an example embodiment of a receiving container of FIG. 1.

Referring to FIGS. 1 and 2, the display apparatus 700 includes a display panel 100 displaying an image, and a backlight assembly BLU providing light to the display panel 100. The display apparatus 700 may further include a mold frame 500 and a top chassis 600. In addition, the display panel 100 and backlight assembly BLU may be physically and electrically connected to a driving part (not shown).

The display panel 100 includes first and second substrates 110 and 120. In one example embodiment, for example, the first substrate 110 may be a thin film transistor substrate including a thin film transistor (not shown) connected to a plurality of signal lines, and a pixel electrode connected to the thin film transistor. The second substrate 120 facing the first substrate 110 is disposed on the first substrate 110. The second substrate 120 may be a color filter substrate including a color filter (not shown) facing the pixel electrode.

The backlight assembly BLU includes a light emitting module 210 and receiving container 301. The backlight assembly BLU may further include a light guide plate 410, a reflective plate 420 and a plurality of optical sheets 430.

The light emitting module 210 includes a plurality of light emitting diodes ("LEDs") 212. The LEDs 212 may be mounted on a printed circuit board ("PCB") 214 electrically connected to the driving part. The printed circuit substrate 214 longitudinally extends along a first direction D1, and the LEDs 212 may be arranged and mounted on the PCB 214 along the first direction D1. The light emitting module 210 is received in the receiving container 301.

The receiving container 301 includes a first frame 310, and a second frame 320 sealed up with the first frame 310. In the illustrated example embodiment, the second frame 320 is disposed outside of the first frame 310, and is sealed up with the first frame 310. Each of the first frame 310 and the second frame 320 may be a single, unitary, indivisible member.

The first frame 310 includes a first bottom 312, and first sidewalls 314 connected to the first bottom 312. The second frame 320 includes a second bottom 322 spaced apart from the first bottom 312, and second sidewalls 324 connected to the second bottom 322. An outside surface of the first bottom 312 faces an inside surface of the second bottom 322. Each outside surface of the first sidewalls 314 is combined with each inside surface of the second sidewalls 324. The first and second sidewalls 314 and 324 combined with each other are defined as sidewalls of a receiving space of the receiving container 301. In the illustrated example embodiment, for example, sidewalls of the receiving container 301 may include a first sidewall portion as the first sidewalls 314, and a second sidewall portion as the second sidewalls 324. In one example embodiment, for example, each of the first and second frames 310 and 320 may include aluminum (Al).

Since the second frame 320 is sealed up with the outside of the first frame 310, the receiving space receiving the light emitting module 210 in the receiving container 301 may be an inside space formed by the first bottom 312 and the first sidewalls 314 of the first frame 310, and the first bottom 312 may directly support the light emitting module 210.

Each of the first and second bottoms 312 and 322 may be divided into a first area A1 in which the light emitting module 210 is disposed, a second area A2 supporting the light guide plate 410 longitudinally extended along a second direction D2 of the first area A1, and a third area A3 disposed between the first area A1 and the second area A2. The first and second areas A1 and A2 of the first bottom 312 on different planes may form a stepped portion, and the first and second areas A1 and A2 of the second bottom 322 on different planes may form a stepped portion. In the illustrated embodiment, for example, the first and second bottoms 312 and 322 in the first area A1 may protrude toward an outside of the receiving container 301 with respect to the first and second bottoms 312 and 322 in the second area A2.

When the receiving container 301 is placed on a flat surface, such as parallel to the ground, each of the first and second bottoms 312 and 322 in the second area A2 is placed further from the flat surface compared to each the first and second bottoms 312 and 322 in the first area A1. Here, the third area A3 may include an inclined surface forming a slope with respect to the flat surface. In the illustrated embodiment, for example, each of the first and second bottoms 312 and 322 in the first and second areas A1 and A2 may be substantially parallel with the flat surface, and each of the first and second bottoms 312 and 322 in the third area A3 may form a slope with respect to the flat surface. The first bottom 312 in FIG. 1 is a space forming portion 315*a* of the first bottom 312 in FIG. 3B, and the second bottom 322 in FIG. 1 is a space forming portion 325*a* of the second bottom 322 in FIG. 3B.

The receiving container 301 includes a heat dissipation channel 330 which is a separate space between the first bottom 312 and the second bottom 322. The heat dissipation channel 330 may be defined by a contact area CA of the receiving container 301 in which the first and second bottoms 312 and 322 partially make contact with each other. The contact area CA corresponds to each edge of the first and second bottoms 312 and 322, and a first edge portion 317 of the first bottom 312 makes contact with a second edge portion 327 of the second bottom 322 in the contact area CA. The first edge portion 317 of the first bottom 312 may be directly connected to the first sidewalls 314, and the second edge portion 327 of the second bottom 322 may be directly connected to the second sidewalls 324. The first edge portion 317 protrudes from the first bottom 312 in the first area A1 and toward an outside of the receiving container 301, and the second edge portion 327 protrudes from the second bottom 322 in the first area A1 and toward an inside of the receiving container 301. Accordingly, the first and second edge portions 317 and 327 make contact with each other, so that the heat dissipation channel 330 is formed as a completely closed and sealed space. The heat dissipation channel 330 may be a vacuum state.

The heat dissipation channel 330 may be divided into a plurality of subspaces PA by a shape of each of the first and second bottoms 312 and 322. The subspaces PA are defined by dividing areas DA of the receiving container 301 corresponding to areas in which the first and second bottoms 312 and 322 make contact with each other. The dividing areas DA may be spaced apart from each other along the first direction D1 in an area surrounded with the contact area CA. The dividing areas DA are spaced apart from each other along the first direction D1, so that the subspaces PA may be spaced apart from each other along the first direction D1. The dividing areas DA longitudinally extend along the second direction D2 different from the first direction D1, so that the subspaces PA may longitudinally extend along the second direction D2. In the illustrated embodiment, for example, one closed space defined by the contact area CA may be divided into a plurality of the subspaces PA by the dividing areas DA. The second direction D2 may be substantially perpendicular to the first direction D1. The second direction D2 may be inclined with the first direction D1 by about 90° in a clockwise direction or a counterclockwise direction.

Alternatively, the dividing areas DA longitudinally extend along a third direction D3 between the first and second directions D1 and D2, so that the subspaces PA may longitudinally extend along the third direction D3. The third direction D3 may be inclined with the first direction D1 by about 45° to about 90° in a clockwise direction or a counterclockwise direction.

The second bottom 322 may include an air outflow 323 exposing the heat dissipation channel 330 to an outside of the receiving container 301. The second bottom 322 is partially open to form the air outflow 323. The air outflow 323 is sealed up with a sealing material CM after a space between the first and second bottoms 312 and 322 is formed to be a vacuum state. In one example embodiment, for example, the sealing material CM is soldered on the outside surface of the second bottom 322 to seal the air outflow 323. Although not shown in the figures, the air outflow 323 may be in an extended line-shape on the second bottom 322 to correspond to each of the subspaces PA. In one example embodiment, for example, one or more of the air outflow 323 may be in the extended line-shape along the first direction D1 on the second bottom 322 facing an area in which the light emitting module 210 is disposed, such that the air outflow 323 overlaps each of the subspaces PA.

The receiving container 301 may further include a first channel layer 340 directly on the second bottom 322 heading (e.g., at a lowermost boundary of) the heat dissipation channel 330, and a refrigerant (not shown) partially filled in the heat dissipation channel 330.

Each of the subspaces PA may be partially filled with the refrigerant. Accordingly, a space except for the areas filled with the refrigerant in the each subspaces PA may be a path for gases to flow through. The refrigerant in the vacuum condition may be vaporized at a temperature, not more than about 60° Celsius. In example embodiments, for example, the refrigerant may include water, alcohol, or acetone.

The first channel layer 340 is in the each of the subspaces PA, and may be on a surface of the second bottom 322 heading the subspaces PA, for example, an inside surface of the second bottom 322. The first channel layer 340 may be capable of moving the refrigerant along a direction by a capillary pressure. An adhesive force is generated between the refrigerant and the inside surface of the second bottom 322 by the first channel layer 340, and then the capillary pressure may be generated, so that the refrigerant may move. In one example embodiment, for example, with the first channel layer 340 on the inside surface of the second bottom 322, the adhesive force between the refrigerant and the first channel layer 340 is added to a cohesive force of the refrigerant, and thus the refrigerant may move in the second direction D2. A further detailed structure of the receiving container 301, and a heat dissipation effect by the refrigerant and the first channel layer 340 will be explained below in detail referring to FIG. 3A to FIG. 3C.

The light guide plate 410 includes first and second surfaces. The first surface faces an inside surface of the first bottom 312, and the second surface is opposite to the first surface. The light guide plate 410 is partially disposed on (e.g., overlapping) the inside surface of the first bottom 312, and is partially disposed on (e.g., overlapping) the light emitting module 210. Accordingly, light generated from the light emitting module 210 is incident into a portion of the first surface of the light guide plate 410, and exits from the second surface.

The light guide plate 410 is disposed on the light emitting module 210 in the first area A1 of the receiving container 301, and may be supported by (e.g., contacted by) the first bottom 312 in the second area A2. In the light guide plate 410, an area of the first surface may be larger than that of the second surface. The light generated from the light emitting module 210 is reflected on a third surface which connects the first surface to the second surface and is disposed adjacent on the light emitting module 210, so that the light may be guided inside of the light guide plate 410. The third surface may be inclined by a certain angle, with respect to the flat surface on which the display apparatus lies. Although not shown in the figure, the third surface may include a reflective layer or a reflective pattern reflecting the light passing through the first surface.

The reflective plate 420 is disposed between the first bottom 312 and the light guide plate 410. The reflective plate 420 faces the first surface of the light guide plate 410. The light reflected on the third surface and reaching the first surface may be reflected to the second surface by the reflective plate 420. The optical sheets 430 may be disposed on the second surface of the reflective plate 420.

The mold frame 500 is disposed in the receiving space of the receiving container 301, fixes the light guide plate 410, the reflective plate 420 and the light emitting module 210 at the receiving container 301, and supports the display panel 100. The mold frame 500 adjacent to the third surface of the light guide plate 410 may include an inclined surface facing the third surface. The inclined surface may include a reflective layer or a reflective pattern reflecting the light passing through the third surface.

Figure 3A:
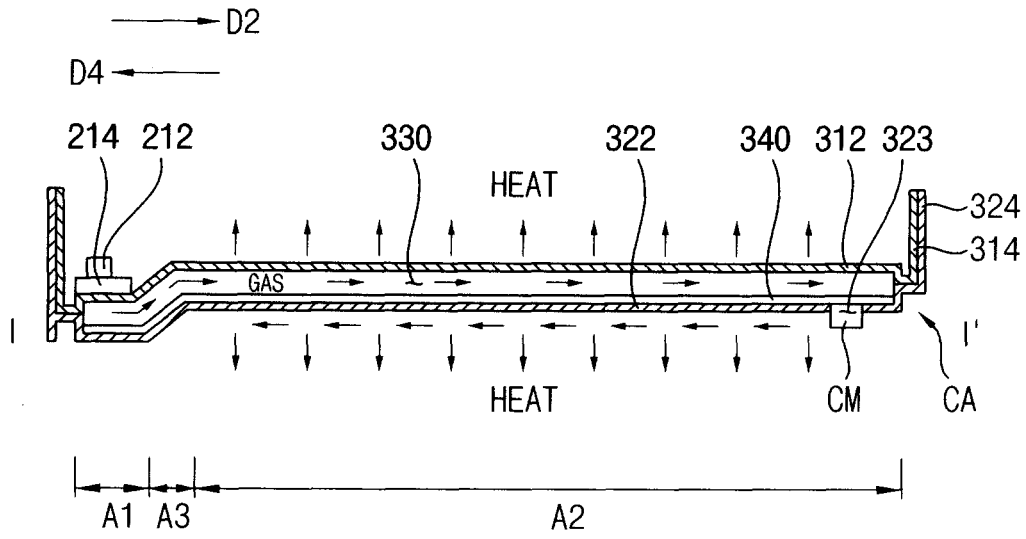
FIG. 3A is a cross-sectional view taken along line I-I' of FIG. 2.

FIG. 3A is a cross-sectional view taken along line I-I' of the receiving container 301 of FIG. 2.

Referring to FIG. 3A, a principle of the heat dissipation in the receiving container 301 in FIG. 1 is explained. As a distance between the light emitting module 210 and the receiving container 301 increases, heat generated from the light emitting module 210 becomes hard to reach the receiving container 301, and thus, the temperature of the first and second bottoms 312 and 322 are relatively decreased as the distance increases. At this point, the refrigerant partially filled in the heat dissipation channel 330 having a vacuum state in the first area A1 closest to the light emitting module 210 may be easily vaporized by the heat generated from the light emitting module 210 to be vapor. Since the refrigerant in the vacuum state has a boiling point lower than the refrigerant in an atmospheric pressure, the refrigerant may be easily vaporized in the heat dissipation channel 330 having the vacuum state.

A gas generated in the first area A1 moves to the second area A2 via the third area A3, through the heat dissipation channel 330, as illustrated by "GAS" and the arrows pointing in the second direction D2 within the heat dissipation channel 330. The gas may continuously move along the second direction D2 in the heat dissipation channel 330. Since the heat moves from an area having relatively higher temperature to an area having relatively lower temperature, the heat may easily move in the heat dissipation channel 330. The heat does not concentrate in the first area A1 which is a relatively higher heated area, but the heat moves to the second area A2 which is a relatively lower heater area, and further moves along the second direction D2 in the second area A2 towards the air outflow 323. The gas moves from the first area A1 along the second direction D2, so that the heat is dissipated to the first and second bottoms 312 and 322 and may be dissipated to the outside of the receiving container 301 and to an outside of the display apparatus 700 through the air outflow 323.

The gas emits the heat in moving along the second direction D2, so that the gas may be liquefied to the refrigerant in a liquid state. The refrigerant in the second area A2 may move to the first area A1 in which the light emitting module 210 continuously supplies the heat, through the first channel layer 340 along a fourth direction D4 opposite to the second direction D2. The refrigerant in the second area A2 may easily move along the fourth direction D4 by a capillary pressure generated due to the adhesive force between the first channel layer 340 and the refrigerant and the cohesive force of the refrigerant. When the refrigerant in the second area A2 reaches the first area A1 again, the refrigerant may be vaporized by the heat generated from the light emitting module 210. The refrigerant is repeatedly vaporized and liquefied as mentioned above, the heat applied in the first area A1 may be easily dissipated in the second area A2. Accordingly, even if the first and second frames 310 and 320 include aluminum (Al) having thermal conductivity of no more than about 138 W/(m·K), the thermal conductivity of the receiving container 301 may be enhanced by about forty times to about eighty times using the refrigerant and the first channel layer 340.

Alternatively, when the display apparatus hangs on a vertical surface substantially perpendicular to the ground, like a wall-mounted type display apparatus, the first and second bottoms 312 and 322 of the receiving container 301 be parallel to the vertical surface. An extension direction of each of the subspaces PA in FIG. 2 is inclined with respect to the ground, such that the first area A1 of each of the subspaces PA is closer to the ground than the second area A2 of the subspaces PA. Since the first area A1 adjacent to the light emitting module 210 is closer to the ground than the second area A2, the refrigerant in the second area A2 may more easily move to the first area A1 under gravity FIG. 3B is a cross-sectional view taken along line II-II' of the receiving container 301 of FIG. 2, and FIG. 3C is an enlarged cross-sectional view of portion 'A' in FIG. 3B.

Figure 3B:
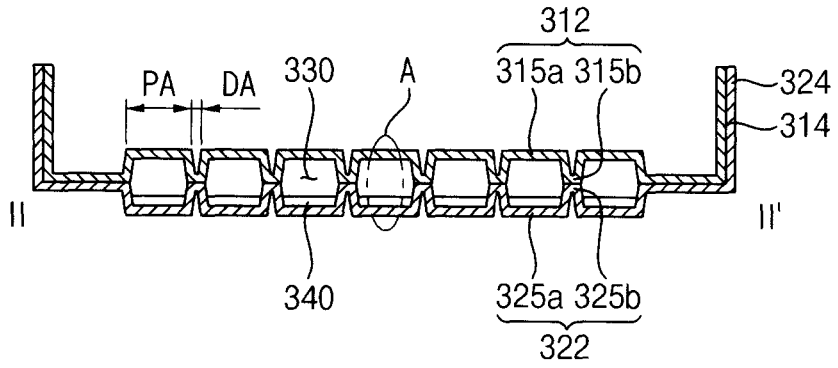
FIG. 3B is a cross-sectional view taken along line II-II' of FIG. 2.
Figure 3C:
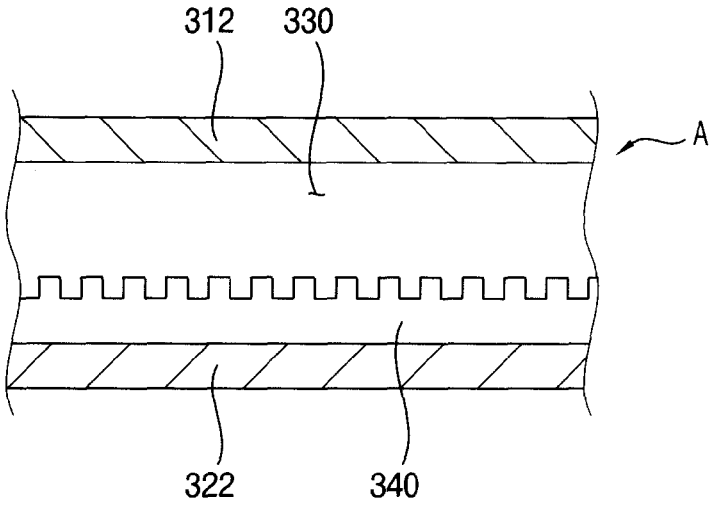
FIG. 3C is an enlarged cross-sectional view of portion 'A' in FIG. 3B.

Referring to FIGS. 3B and 3C, the first channel layer 340 may include a metal layer having a groove pattern (refer to FIG. 3C) on a surface of the metal layer longitudinally extending to the second direction D2. The groove pattern extends along the second direction D2, so that the refrigerant may easily move through the first channel layer 340 along the fourth direction D4.

The first bottom 312 may include a plurality of space forming portions 315*a* protruding toward the outside of the heat dissipation channel 330, and a plurality of boundary portions 315*b* respectively disposed between adjacent space forming portions 315*a* and protruding toward the heat dissipation channel 330. Each of the forming portions 315*a* has substantially same width in the first direction D1. Each of the space forming portions 315*a* has a width larger than that of a width of each of the boundary portions 315*b* in the first direction D1.

In addition, the second bottom 322 may include a plurality of space forming portions 325*a* protruding toward the outside of the heat dissipation channel 330, and a plurality of boundary portions 325*b* respectively disposed between adjacent space forming portions 325*a* and protruding toward the heat dissipation channel 330. When the first and second bottoms 312 and 322 are combined with each other, the boundary portions 315*b* of the first bottom 312 and the boundary portions 325*b* of the second bottom 322 make direct contact with each other. Thus, the heat dissipation channel 330 may be divided into the subspaces PA in the first direction D1.

Accordingly, the subspaces PA described in FIG. 2 are defined by the space forming portions 315*a* of the first bottom 312 and the space forming portions 325*a* of the second bottom 322, and the dividing areas DA are defined by the boundary portions 315*b* of the first bottom 312 and the boundary portions 325*b* of the second bottom 322.

Figure 4:
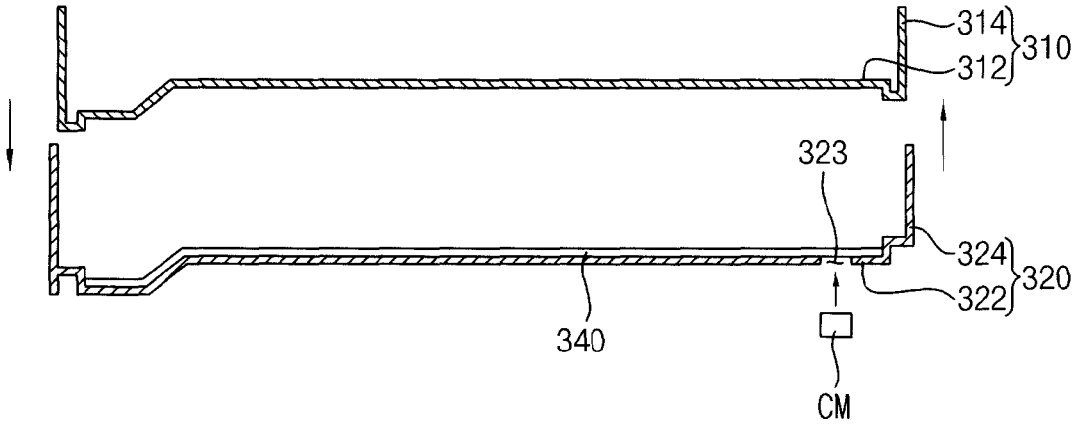
FIG. 4 is a cross-sectional view illustrating an example embodiment of a method of manufacturing the receiving container in FIG. 2.

FIG. 4 is a cross-sectional view illustrating an example embodiment of a method of manufacturing the receiving container 301 described in FIG. 2.

Referring to FIG. 4, each of the first and second fame parts 310 and 320 may be separately manufactured, such as by using an injection molding process. Before the second frame 320 is combined with the first frame 310, a portion of the second frame 320 at the air outflow 323 where there is no material of the second frame 320, is maintained to be open by the sealing material CM. The first channel layer 340 may be on the inside surface of the second bottom 312.

The edge portion 317 of the first bottom 312 corresponding to the contact area CA is designed to be protruded from the area including the heat dissipation channel 330, toward the outside of the first frame 310. In addition, the edge portion 327 of the second bottom 322 corresponding to the contact area CA is designed to be protruded from the area including the heat dissipation channel 330, toward the inside of the first frame 310. Accordingly, when the first and second bottoms 312 and 322 are combined with each other, the edge portions 317 and 327 make direct contact with each other. Thus, the heat dissipation channel 330 may be formed as a closed space.

The first frame 310 is disposed over the second frame 320, so that the first channel layer 340 and the outside surface of the first bottom 312 face each other. When the first and second bottoms 312 and 322 are combined with each other, the outside surface of the first sidewalls 314 makes contact with the inside surface of the second sidewalls 324, and the edge portions 317 and 327 makes contact with each other. In addition, the boundary portions 315*b* of the first bottom 312 and the boundary portions 325*b* of the second bottom 322 make contact with each other as illustrated in FIG. 3B. Accordingly, the heat dissipation channel 330 is solely formed by the assembled first and second bottoms 312 and 322. In addition, the heat dissipation channel 330 of the assembled first and second frames 210 and 320 may be divided into the subspaces PA in the first direction D1.

Then, air in the heat dissipation channel 330 is removed through the air outflow 323, so that the heat dissipation channel 330 may be in a vacuum state. Then, the heat dissipation channel 330 is partially filled with the refrigerant, and the air outflow 323 is sealed up using the sealing material CM. The above-mentioned method is repeatedly performed for each of the subspaces PA. Accordingly, the receiving container 301 as illustrated in FIGS. 1 and 2 may be manufactured.

In the illustrated example embodiment, since the heat dissipation channel 330 in the receiving container 301 is formed solely by combining the first and second frames 310 and 320 with each other, additional heat dissipating means combined with the receiving container 301 may be unnecessary, and an overall thickness of the display apparatus 700 may be minimized. In addition, the refrigerant and the first channel layer 340 are used for the heat dissipation channel 330, so that a thermal conductivity of the receiving container 301 may be further improved as the thermal conductivity of a superconductor. Thus, heat dissipation may be increased.

In the illustrated example embodiment, the light emitting module 210 is disposed at one side of the receiving container 301. Alternatively, the light emitting module 210 may be disposed at both of opposing sides of the receiving container 301 to face each other. In addition, the light emitting module 210 may be disposed at areas adjacent to four sides of the receiving container 301. In this case, each area in which the light emitting module 210 is disposed may be designed to be protruded toward the outside of the receiving container 301 as the first area A1 illustrated in FIG. 1.

Figure 5A:
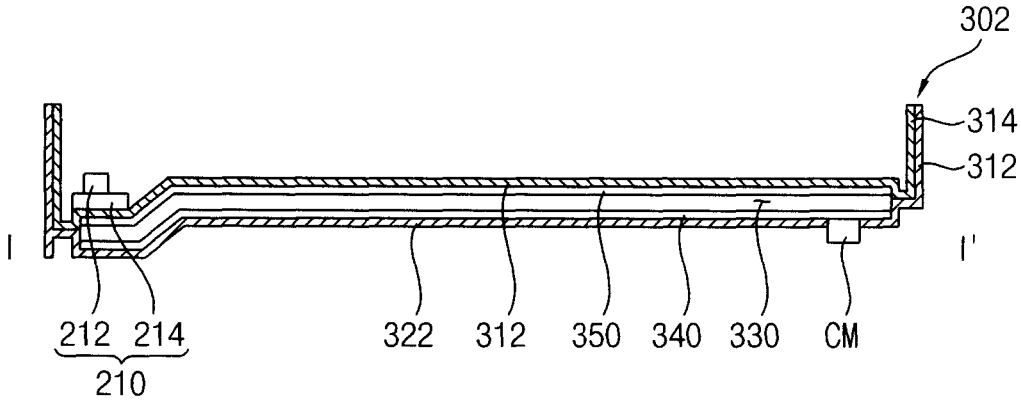
FIGS. 5A and 5B are cross-sectional views illustrating another example embodiment of a receiving container according to the invention.
Figure 5B:
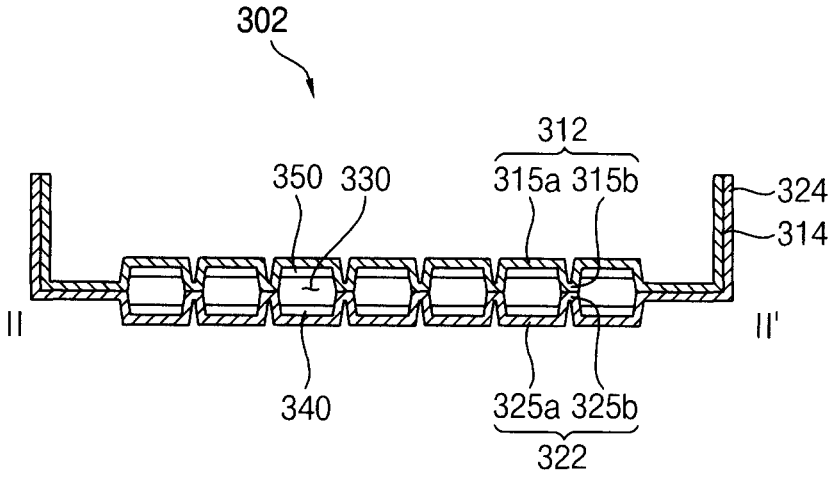

FIGS. 5A and 5B are cross-sectional views illustrating another example embodiment of a receiving container according to the invention.

A backlight assembly according to the illustrated example embodiment is substantially same as the backlight assembly according to the previous example embodiment in FIG. 1 except for a receiving container 302. In addition, the receiving container 302 according to the illustrated example embodiment is substantially same as the receiving container 301 in FIGS. 2, 3A and 3B except that the receiving container 302 further includes a second channel layer 350. Thus, any further repetitive explanation concerning the above elements will be omitted. In addition, since a plan view illustrating the receiving container 302 according to the illustrated example embodiment is substantially same as FIG. 2, the receiving container 302 will be explained with reference to FIG. 2.

Referring to FIGS. 2, 5A and 5B, the receiving container 302 includes the first frame 310 including the first bottom 312, and the second frame 320 including the second bottom 322. The first and second bottoms 312 and 322 are spaced apart from each other, so that the heat dissipation channel 330 is formed therebetween.

The first channel layer 340 is on the inside surface of the second bottom 322 heading the heat dissipation channel 330. The second channel layer 350 is on the outside surface of the first bottom 312 heading (e.g., at an uppermost boundary of) the heat dissipation channel 330. Accordingly, the first and second channel layers 340 and 350 face each other. Each of the first and second channel layers 340 and 350 may include a metal layer having a groove pattern illustrated in FIG. 3C.

According to the illustrated example embodiment, the second channel layer 350 is with the first channel layer 340 in the head dissipation channel 330, so that a refrigerant partially filled in the heat dissipation channel 330 may be retrieved more quickly to an area in which a light emitting module 210 is disposed. Thus, the receiving container 302 according to the illustrated example embodiment may dissipate the heat much faster than the receiving container 301 according to the previous example embodiment in FIG. 3A. Thus, heat dissipation characteristic may be more enhanced.

Figure 6A:
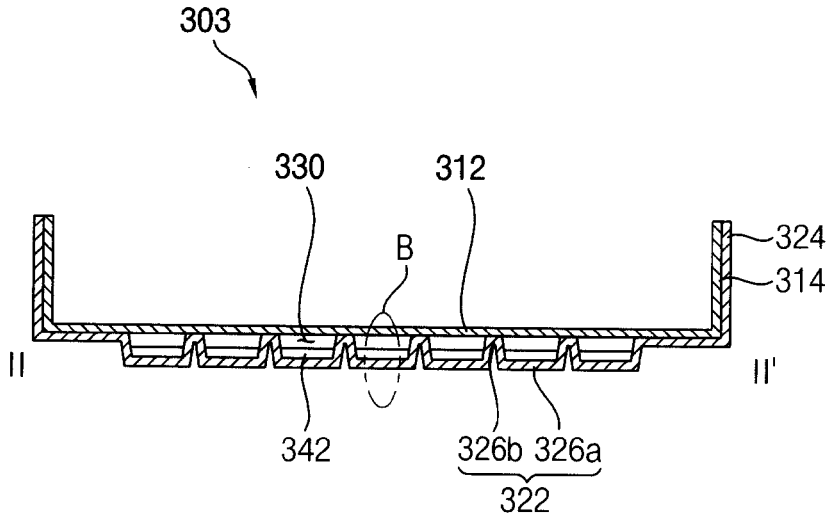
FIG. 6A is a cross-sectional view illustrating still another example embodiment of a receiving container according to the invention.
Figure 6B:
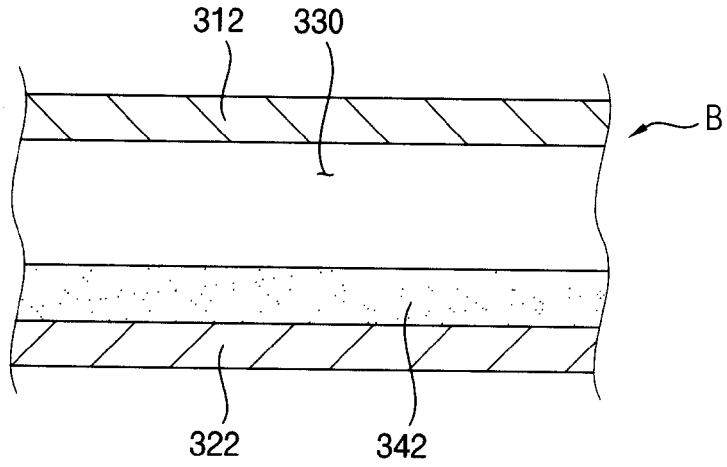
FIG. 6B is an enlarged cross-sectional view of portion 'B' in FIG. 6A.

FIG. 6A is a cross-sectional view illustrating still another example embodiment of a receiving container according to the invention. FIG. 6B is an enlarged cross-sectional view of portion 'B' in FIG. 6A.

A backlight assembly according to the illustrated example embodiment is substantially same as the backlight assembly according to the previous example embodiment in FIGS. 1 and 2 except a receiving container 303. In the receiving container 303 according to the illustrated example embodiment, a cross-sectional shape of the receiving container 303 taken along line I-I' in FIG. 2 is substantially same as that illustrated in the FIG. 3A, but a cross-sectional shape of the receiving container 303 taken along line II-II' in FIG. 2 is different from that illustrated in the FIG. 3A. Accordingly, a difference will be explained below in detail and any further repetitive explanation concerning the same or like parts will be omitted. Since a plan view illustrating the receiving container 303 according to the illustrated example embodiment is substantially same as that in FIG. 2, the receiving container 303 will be explained with reference to FIG. 2.

Referring to FIGS. 2 and 6A, in a cross-sectional shape of the receiving container 303 taken along line II-II' in FIG. 2, the first bottom 312 of the receiving container 303 is completely flat between the first sidewalls 314. The second bottom 322 includes space forming portions 326*a* protruding toward an outside of the receiving container 303, which is opposite to a direction heading a heat dissipation channel 330, and boundary portions 326*b* disposed between adjacent space forming portions 326*a*.

Each of the boundary portions 326*b* of the second bottom 322 directly makes contact with a flat surface of the first bottom 312 facing the second bottom 322, so that dividing areas DA illustrated in FIG. 2 are defined. In addition, the heat dissipation channel 330 may be divided into a plurality of subspaces PA by the dividing areas DA. Each of the space forming portions 326*a* of the second bottom 322 is spaced apart from the flat surface of the first bottom 312 facing the second bottom 322, so that each of the subspaces PA may be defined. Each of the subspaces PA is partially filled with a refrigerant, and a first channel layer 342 may be on the surface of the second bottom 322 heading the heat dissipation channel 330 in each of the space forming portions 326*a*.

Referring to FIG. 6B, the first channel layer 342 may include a metal layer having a plurality of sintered metal particles. In an example embodiment the first channel layer 342 may be on the second bottom 322 by sintering a metal powder at a thin film layer which is a base substrate.

Alternatively, the first channel layer 342 may include a metal layer having a groove pattern illustrated in FIG. 3C. Although not shown in the figures, a second channel layer may be on a surface of the first bottom 312 heading the heat dissipation channel 330 to face the first channel layer 340. The second channel layer may include a metal layer illustrated in FIG. 6B, or the metal layer illustrated in FIG. 3C.

Figure 7A:
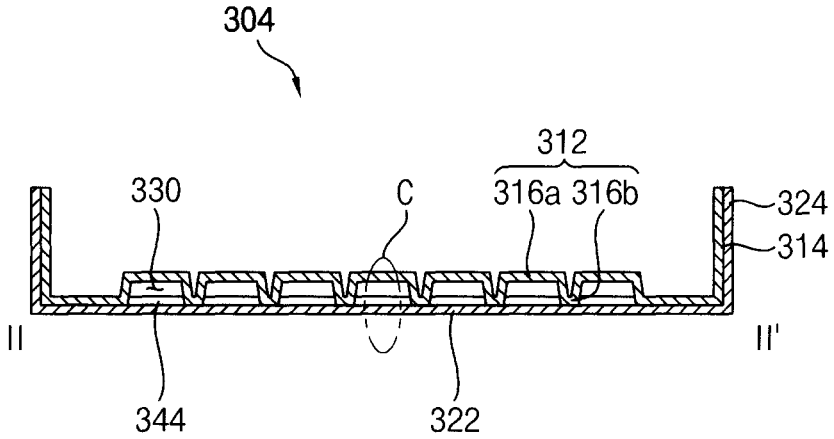
FIG. 7A is a cross-sectional view illustrating still another example embodiment of a receiving container according to the invention.
Figure 7B:
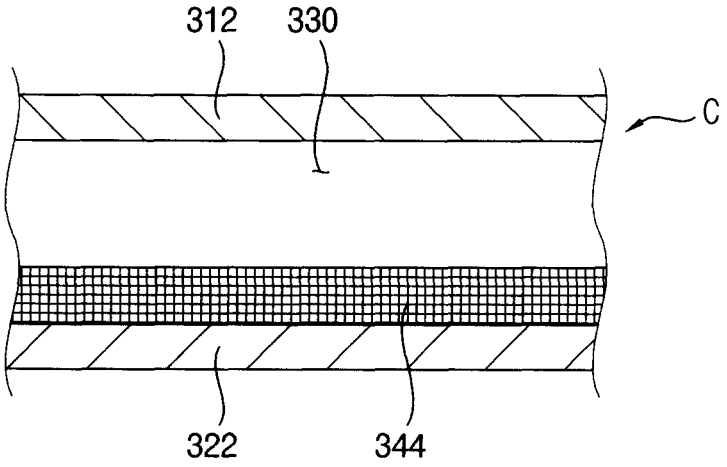
FIG. 7B is an enlarged cross-sectional view of portion 'C' in FIG. 7A.

FIG. 7A is a cross-sectional view illustrating still another example embodiment of a receiving container according to the invention. FIG. 7B is an enlarged cross-sectional view of portion 'C' in FIG. 7A.

A backlight assembly according to the illustrated example embodiment is substantially same as the backlight assembly according to the previous example embodiment in FIGS. 1 and 2 except for a receiving container 304. In the receiving container 304 according to the illustrated example embodiment, a cross-sectional shape of the receiving container 304 taken along line I-I' in FIG. 2 is substantially same as that illustrated in the FIG. 3A, but a cross-sectional shape of the receiving container 304 taken along line II-II' in FIG. 2 is different from that illustrated in the FIG. 3A. Accordingly, a difference will be explained below in detail and any further repetitive explanation concerning the same or like parts will be omitted. Since a plan view illustrating the receiving container 304 according to the illustrated example embodiment is substantially same as that in FIG. 2, the receiving container 304 will be explained with reference to FIG. 2.

Referring to FIGS. 2 and 7A, a first bottom 312 of the receiving container 304 includes space forming portions 316*a* protruding toward an outside of the receiving container 304, which is opposite to a direction heading a heat dissipation channel 330, and boundary portions 316*b* disposed between adjacent space forming portions 316*a*. In a cross-sectional shape of the receiving container 304 taken along line II-II' in FIG. 2, a second bottom 322 of the receiving container 304 is completely flat between the second sidewalls 324. Each of the boundary portions 316*b* of the first bottom 312 directly makes contact with a flat surface of the second bottom 322 facing the first bottom 312, so that dividing areas DA illustrated in FIG. 2 are defined. In addition, the heat dissipation channel 330 may be divided into a plurality of subspaces PA by the dividing areas DA. Each of the subspaces PA is partially filled with a refrigerant, and a first channel layer 344 may be on the surface of the first bottom 312 heading the heat dissipation channel 330 in each of the space forming portions 316*a*.

Referring to FIG. 7B, the first channel layer 344 may include a metal layer having a mesh pattern. Thin and long metal wires are connected with each other like a net shape to be formed as the mesh pattern, and the mesh pattern is combined with the second bottom 322, so that the first channel layer 344 is on the second bottom 322.

Alternatively, the first channel layer 344 may include sintered metal particles illustrated in FIG. 6B, or a metal layer having a groove pattern illustrated in FIG. 3C. Although not shown in the figures, a second channel layer may be on a surface of the first bottom 312 heading the heat dissipation channel 330 to face the first channel layer 344. The second channel layer may include the metal layer illustrated in FIG. 6B, or the metal layer illustrated in FIG. 3C, or a metal layer illustrated in FIG. 7B.

According to the receiving containers 303 and 304 illustrated in FIGS. 6A, 6B, 7A and 7B, space forming portions and boundary portions are on one of the first and second bottoms 312 and 322, so that the heat dissipation channel 330 may be divided into the subspaces PA. In addition, the first channel layer or the second channel layer includes one of metal layers including the groove pattern, the sintered metal particles and the mesh pattern, so that the refrigerant may move using a capillary pressure.

Figure 8:
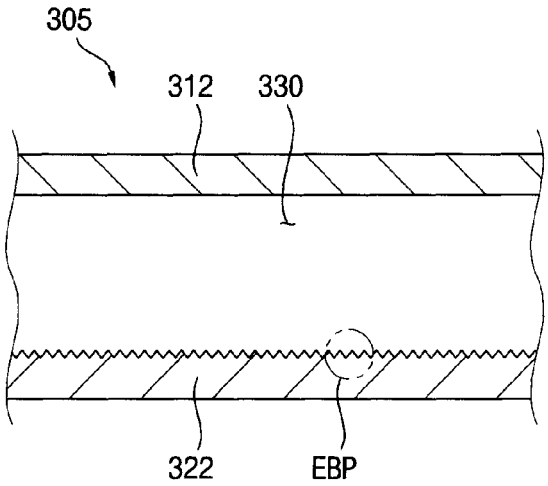
FIG. 8 is an enlarged cross-sectional view illustrating still another example embodiment of a receiving container according to the receiving container.

FIG. 8 is a cross-sectional view illustrating still another example embodiment of a receiving container according to the invention.

A backlight assembly according to the illustrated example embodiment is substantially same as the backlight assembly according to the previous example embodiment in FIGS. 1 and 2 except for a receiving container 305. In addition, the receiving container 305 according to the illustrated example embodiment is substantially same as the receiving container 301 according to the previous example embodiment in FIGS. 2 and 3A, except that a groove pattern is directly on a surface of the receiving container 305 without the first channel layer. FIG. 8 is an enlarged cross-sectional view taken along line II-II' of the receiving container 305 according to the illustrated example embodiment like FIG. 2. Thus, a difference will be explained below in detail and any further repetitive explanation concerning the same or like parts will be omitted.

Referring to FIG. 8, the receiving container 305 includes the first and second bottoms 312 and 322. The first and second bottoms 312 and 322 are spaced apart from each other, so that a heat dissipation channel 330 is formed therebetween. The second bottom 322 includes a groove pattern is directly on an inside surface EBP of the second bottom 322 heading the heat dissipation channel 330.

The groove pattern is directly formed on the surface of the receiving container 305. In one example embodiment, when the second bottom 322 is manufactured, the groove pattern is directly formed on the inside surface EBP of the second bottom 322. Thus, a process of combining an additional channel layer with the receiving container 305 may be omitted, so that manufacturing process of the receiving container 305 may be simplified. Alternatively, sintered metal particles or a mesh pattern may be formed on the inside surface EBP.

In addition, when the groove pattern is formed on the inside surface EBP, a groove pattern, sintered metal particles, or a mesh pattern may be further formed on an outside surface of the first bottom 312 heading the heat dissipation channel 330, and an additional channel layer may be formed on the first bottom 312.

Figure 9A:
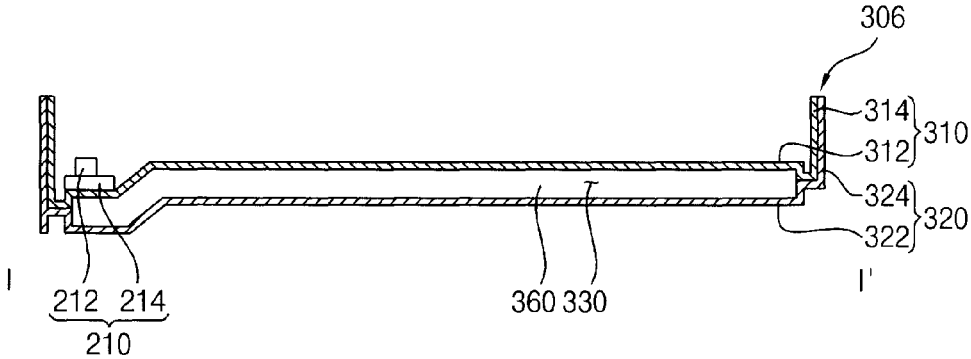
FIGS. 9A and 9B are cross-sectional views illustrating still another example embodiment of a receiving container according to the invention.
Figure 9B:
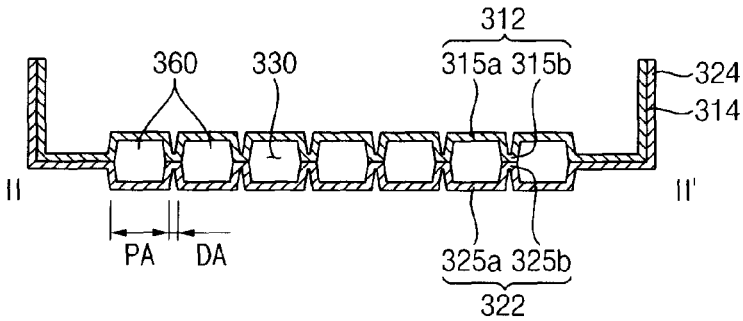

FIGS. 9A and 9B are cross-sectional views illustrating still another example embodiment of a receiving container according to the invention.

A backlight assembly according to the illustrated example embodiment is substantially same as the backlight assembly according to the previous example embodiment in FIGS. 1 and 2 except for a receiving container 306. The receiving container 306 according to the illustrated example embodiment is substantially same as the receiving container 301 according to the previous example embodiment in FIGS. 2 and 3A except that a graphite is disposed in the heat dissipation channel 330. Accordingly, a difference will be explained below in detail and any further repetitive explanation concerning the same or like parts will be omitted. Since a plan view illustrating the receiving container 306 according to the illustrated example embodiment is substantially same as that in FIG. 2, the receiving container 306 will be explained with reference to FIG. 2.

Referring to FIGS. 2, 9A and 9B, the receiving container 306 according to the illustrated example embodiment includes the first and second bottoms 312 and 322. The first and second bottoms 312 and 322 are spaced apart from each other, so that the heat dissipation channel 330 is formed therebetween. The graphite 360 is interposed between the first and second bottoms 312 and 322. In one example embodiment, for example, the heat dissipation channel 330 may be completely or partially filled with the graphite 360.

Since the graphite 360 is a material having high thermal conductivity and the graphite is in the heat dissipation channel 330, heat generated from the light emitting module 210 is effectively dissipated. The graphite 360 may be interposed in each of subspaces PA of the heat dissipation channel 330.

Although not shown in the figures, since the graphite 360 has good thermal conductivity but a high cost price, some of the subspaces PA may be only filled with the graphite 360. In this case, the other subspaces PA are not filled with the graphite 360, and remain empty to be a vacuum state.

Figure 10:
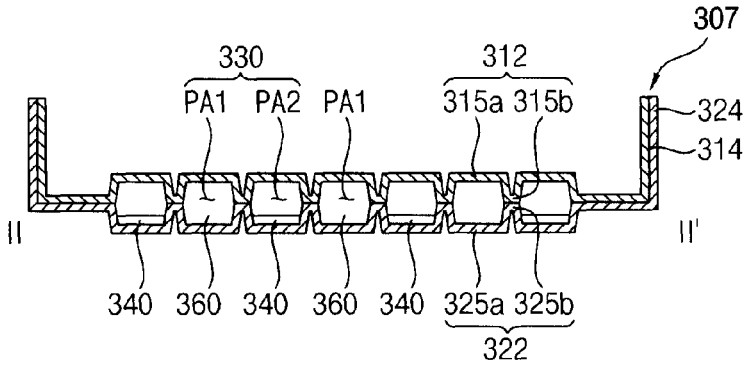
FIG. 10 is a cross-sectional view illustrating still another example embodiment of a receiving container according to the invention.

FIG. 10 is a cross-sectional view illustrating still another example embodiment of a receiving container according to the invention.

A backlight assembly according to the illustrated example embodiment is substantially same as the backlight assembly according to the previous example embodiment in FIGS. 1 and 2 except for a receiving container 307. The receiving container 307 according to the illustrated example embodiment is substantially same as the receiving container 301 according to the previous example embodiment in FIGS. 2, 3A and 3B, except that some of subspaces PA of the receiving container include refrigerant and the other subspaces PA include graphite. Accordingly, a difference will be explained below in detail and any further repetitive explanation concerning the same or like parts will be omitted. Since a plan view illustrating the receiving container 307 according to the illustrated example embodiment is substantially same as that in FIG. 2, the receiving container 307 will be explained with reference to FIG. 2.

Referring to FIG. 10, the heat dissipation channel 330 defined by the first and second bottoms 312 and 322 is divided into a plurality of subspaces including first and second subspaces PA1 and PA2, by boundary portions 315*b* of the first bottom 312 and boundary portions 325*a* of the second bottom 322.

The subspaces PA1 and PA2 are alternately disposed along the first direction D1. The receiving container 307 includes the graphite 360 completely filled in each of the first areas PA1. Each of the second areas PA2 includes the refrigerant filled therein, and the first channel layer 340. The first channel layer 340 may be on a surface of the space forming portions 325*a* heading the second subspaces PA2.

In the illustrated example embodiment, the receiving container 307 only includes the first channel layer 340 in the second areas PA2, but alternatively the receiving container 307 may further include a second channel layer (not shown) on each surfaces of the space forming portions 315*a* heading the subspaces PA2. Alternatively, the first channel layer 340 or the second channel layer is omitted, and the receiving container 307 may include a groove pattern, sintered metal particles, or a mesh pattern may be directly on a surface of the receiving container 307.

According to the illustrated example embodiment, each of the first areas PA1 is filled with the graphite 360, and each of the second areas PA2 is partially filled with the refrigerant and includes the first channel layer 340, so that heat dissipation efficiency may be enhanced.

Figure 11:
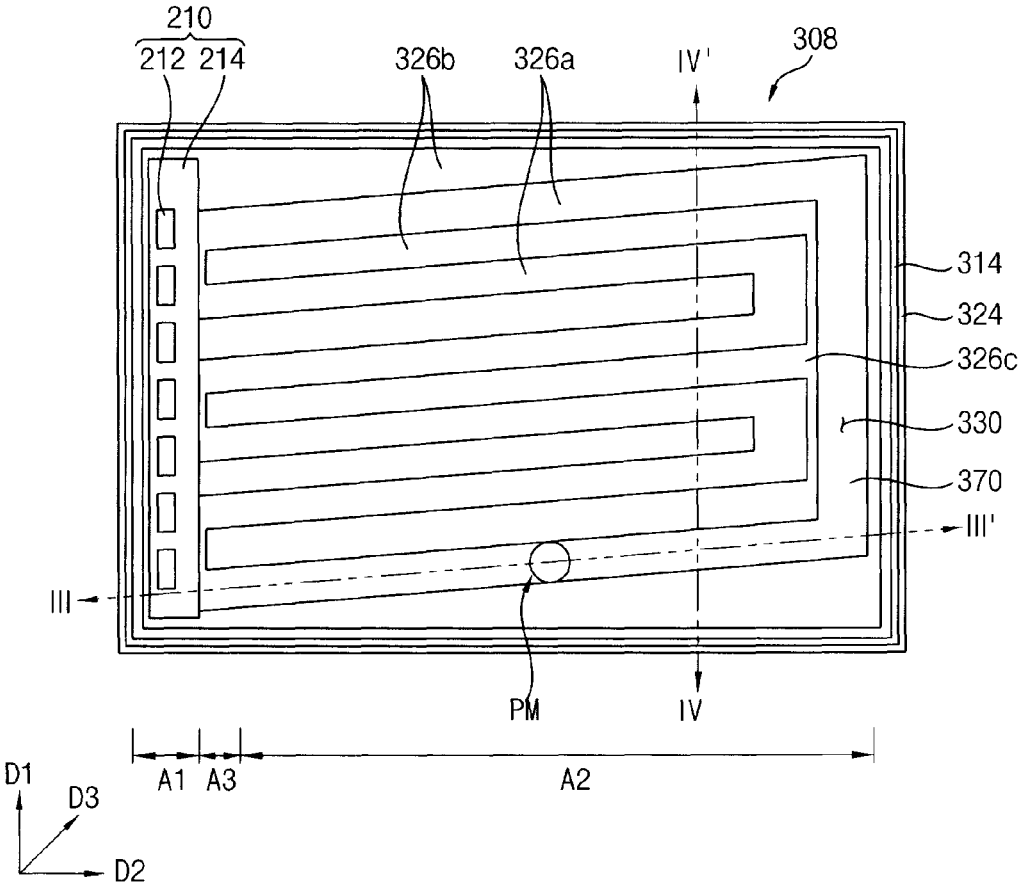
FIG. 11 is a plan view illustrating still another example embodiment of a receiving container according to the invention.
Figure 12:
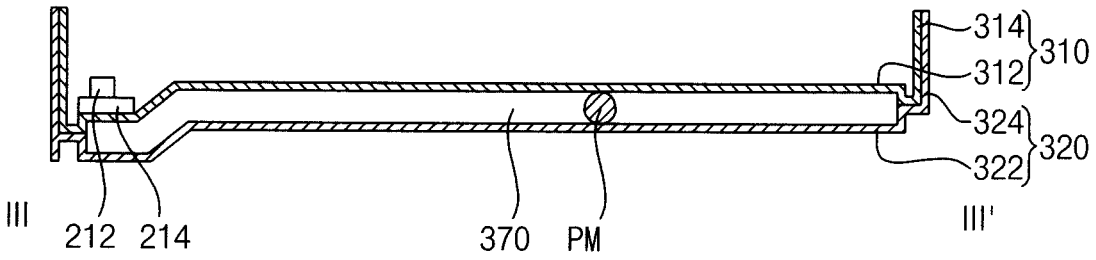
FIG. 12 is a cross-sectional view taken along line III-III' of FIG. 11.
Figure 13:
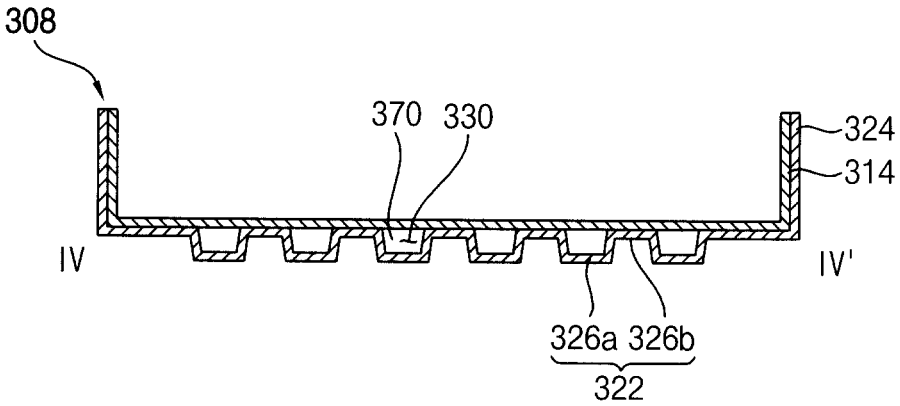
FIG. 13 is a cross-sectional view taken along line IV-IV' of FIG. 11.

FIG. 11 is a plan view illustrating still another example embodiment of a receiving container according to the invention. FIG. 12 is a cross-sectional view taken along line III-III' of the receiving container of FIG. 11. FIG. 13 is a cross-sectional view taken along line IV-IV' of the receiving container of FIG. 11.

A backlight assembly according to the illustrated example embodiment is substantially same as the backlight assembly according to the previous example embodiment in FIGS. 1 and 2, except for a receiving container 308. Accordingly, a difference will be explained below in detail and any further repetitive explanation concerning the same or like parts will be omitted.

Referring to FIGS. 11, 12 and 13, the receiving container 308 includes the first frame 310 including the first bottom 312 and the first sidewalls 314, and the second frame 320 including the second bottom 322 and the second sidewalls 324. The first and second bottoms 312 and 322 are spaced apart from each other, so that a heat dissipation channel 330 is formed therebetween.

In the illustrated embodiment, for example, the first bottom 312 may include a flat surface. The second bottom 322 includes the first boundary portions 326*b* protruding toward the heat dissipation channel 330, the space forming portions 326*a* disposed between adjacent first boundary portions 326*b* and protruding opposite to a direction heading the heat dissipation channel 330, and a second boundary portions 326*c* connected to the first boundary portions 326*b*. The second boundary portions 326*c* longitudinally extend along the first direction D1, and the first boundary portions 326*b* longitudinally extend along the second direction D2 different from the first direction D1. The heat dissipation channel 330 may be divided into a plurality of subspaces PA separated from each other in the first direction D1 by the first boundary portions 326*b*. In addition, the heat dissipation channel 330 may be divided into subspaces PA separated from each other in the second direction D2 by the second boundary portions 326*c*, and the subspaces PA divided by the second boundary portions 326*c* may be partially connected with the subspaces PA by the first boundary portions 326*b*. Accordingly, the heat dissipation channel 330 may be defined as a continuous zigzag shape circulation space by the first and second boundary portions 326*b* and 326*c*. Thus, the space forming portions 326*a* may be the zigzag shape like a configuration of the heat dissipation channel 330.

Alternatively, the first bottom 312 may include boundary portions and space forming portions corresponding to the first and second boundary portions 326*b* and 326*c* and the space forming portions 326*a* of the second bottom 322 respectively. In one example embodiment, for example, the first and second bottoms 312 and 322 may include boundary portions and space forming portions as illustrated in FIG. 3B, so that a united zigzag shape circulation space may be formed.

The receiving container 308 may further include the refrigerant 370 and a circulation pump PM. The heat dissipation channel 330 may be fully filled with the refrigerant 370. The circulation pump PM is connected to the heat dissipation channel 330, and provides a power source in order that the refrigerant 370 continuously circulates along the circulation space of the heat dissipation channel 330.

According to the illustrated example embodiment, without additional heat dissipation means received by or connected to the receiving container 308, heat generated from the light emitting module 210 may be dissipated using the heat dissipation channel 330 which is solely defined by the first and second frames 310 and 320 and directly in the receiving container 308.

Figure 14:
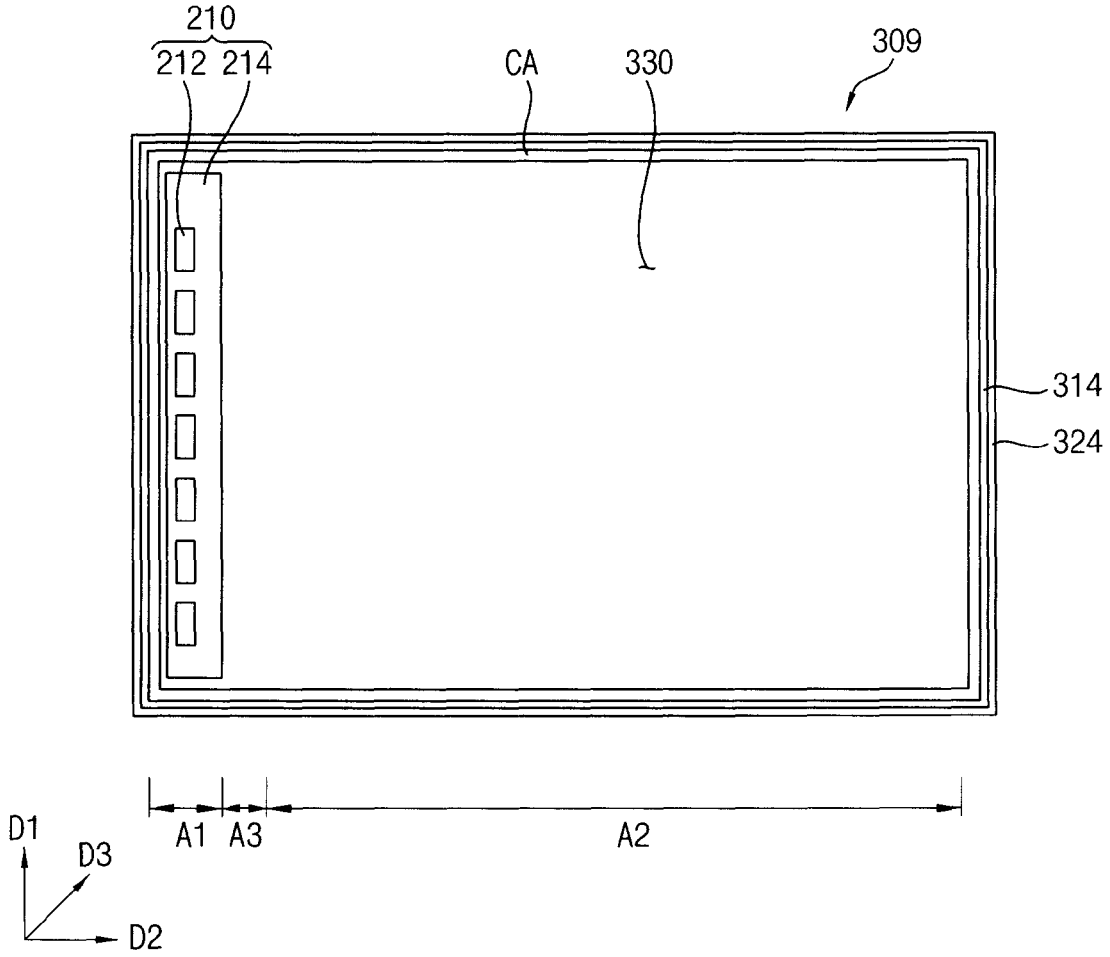
FIG. 14 is a plan view illustrating still another example embodiment of a receiving container according to the invention.

FIG. 14 is a plan view illustrating still another example embodiment of a receiving container according to the invention.

A backlight assembly according to the illustrated example embodiment is substantially same as the backlight assembly according to the previous example embodiment in FIGS. 1 and 2 except for a receiving container 309. The receiving container 309 according to the illustrated example embodiment is substantially same as the receiving container 301 according to the previous example embodiment in FIGS. 1 and 3A except that the heat dissipation channel 330 of the receiving container 309 is a single united space without divided subspaces as illustrated in FIG. 2. Accordingly, a difference will be explained below in detail and any further repetitive explanation concerning the same or like parts will be omitted.

Referring to FIGS. 1 and 14, the receiving container 309 includes the heat dissipation channel 330 which is a space between first and second bottoms 312 and 322. The heat dissipation channel 330 may be defined by a contact area CA in which the first and second bottoms 312 and 322 partially make contact with each other. The contact area CA may be a boundary area of the first and second bottoms 312 and 322. The heat dissipation channel 330 may be in a vacuum state. The heat dissipation channel 330 is defined as one closed space unlike the heat dissipation channel 330 in FIG. 2.

The receiving container 309 may include the refrigerant (not shown) filled in the heat dissipation channel 330, and the first channel layer 340. The first channel layer 340 is disposed on at least one surface of the first and second bottoms 312 and 322 heading the heat dissipation channel 330, and moves the refrigerant using a capillary pressure. Alternatively, the receiving container 309 may include the graphite (not shown) filled in the heat dissipation channel 330. In the receiving container 309, at least directly one surface of the first and second bottoms 312 and 322 heading the heat dissipation channel 330 may include a groove pattern, sintered metal particles, or a mesh pattern.

Figure 15:
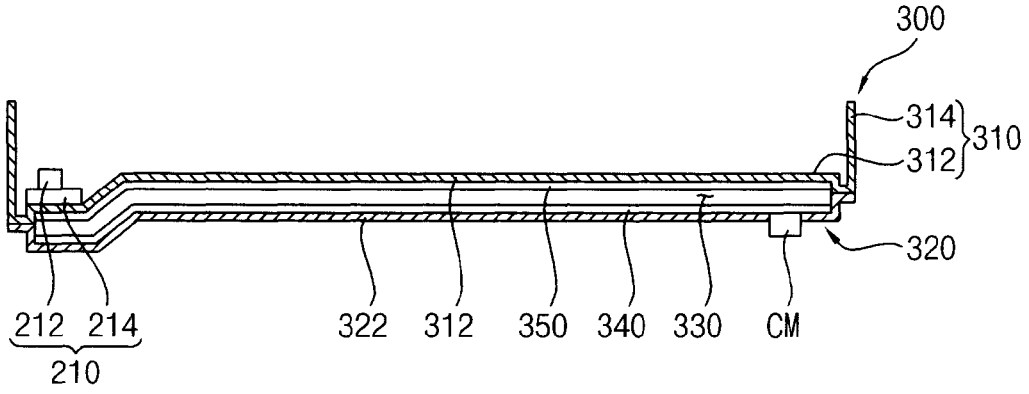
FIG. 15 is a cross-sectional view illustrating still another example embodiment of a receiving container according to the invention.

FIG. 15 is a cross-sectional view illustrating still another example embodiment of a receiving container according to the invention.

According to the illustrated example embodiment, a backlight assembly is substantially same as the backlight assembly described in FIGS. 1 and 2 except a receiving container 300. The receiving container 300 according to the illustrated example embodiment is substantially same as the receiving container 301 according to the previous example embodiment in FIGS. 2 and 3A, except that sidewalls of the receiving container 300 only include the first sidewalls 314 connected to the first bottom 312. Thus, a difference will be explained below in detail and any further repetitive explanation concerning the same or like parts will be omitted.

Referring to FIG. 15, the receiving container 300 includes the first frame 310 including the first bottom 312 and the first sidewalls 314, and the second frame 320 including the second bottom 322 facing the first bottom 312. A thickness of each of the sidewalls 314 of the receiving container 300 illustrated in FIG. 15 may be relatively thicker than that of the receiving container 301 illustrated in FIG. 1. In one example embodiment, for example, the second frame 320 having a substantially plate shape without additional sidewalls is combined with the first frame 310, so that a heat dissipation channel 330 may be formed therebetween.

In the example embodiments explained in FIG. 1 to FIG. 15, the first area A1 of the receiving container in which a light emitting module is disposed and the second area A2 of the receiving container form the stepped portion and thus the light guiding plate 410 is disposed over the light emitting module 210, as illustrated in FIG. 1. In the edge-illumination type backlight assembly including a receiving container receiving a light emitting module and the light guide plate which face each other, the receiving container is configured to include the first and second frames 310 and 320 solely defining a heat dissipation channel, so that a heat dissipation characteristic of the backlight assembly may be enhanced.

According to the example embodiments mentioned above, a heat dissipation channel in the receiving container is solely formed by combining first and second frames with each other, so that an overall thickness of a display apparatus including the dissipation channel may be decreased because an additional dissipating means is not needed in the receiving container. In addition, a refrigerant and a first channel layer, or the graphite may be within the heat dissipation channel, so that thermal conductivity of the receiving container may be further improved closer to the thermal conductivity of a superconductor. Thus, heat dissipation may be increased regardless of a thermal conductivity range of a material included in the receiving container.

The foregoing is illustrative of the invention and is not to be construed as limiting thereof. Although a few example embodiments have been described, those skilled in the art will readily appreciate that many modifications are possible in the example embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific example embodiments disclosed, and that modifications to the disclosed example embodiments, as well as other example embodiments, are intended to be included within the scope of the appended claims. The invention is defined by the following claims, with equivalents of the claims to be included therein.

What is claimed is:

1. A backlight assembly comprising:

a light emitting module; and a receiving container comprising a first frame, a second frame and a heat dissipation channel, wherein the first and second frames receive the light emitting module, the first frame comprising a first bottom, and first sidewalls connected to the first bottom, and the second frame comprising a second bottom which faces the first bottom of the first frame, and is connected to the first frame, wherein the first and second bottoms are spaced apart from each other and form the heat dissipation channel therebetween, the light emitting module comprises a plurality of light sources arranged along and facing a same first sidewall of the first frame, and the first bottom of the first frame comprises a first area in which the plurality of light sources is disposed, and a second area comprising a stepped portion.

2. The backlight assembly of claim 1, wherein at least one of the first bottom and the second bottom comprises boundary portions disposed along a first direction, extending along a second direction different from the first direction, and protruding toward the heat dissipation channel, and the heat dissipation channel is divided into a plurality of subspaces by the boundary portions respectively, the subspaces being spaced apart from each other along the first direction.

3. The backlight assembly of claim 2, wherein the receiving container further comprises:

a refrigerant which partially fills each of the subspaces; and a channel layer in each of the subspaces of the heat dissipation channel and on a surface of at least one of the first bottom and the second bottom, the surface being furthest away from the other bottom, wherein the channel layer moves the refrigerant using a capillary pressure.

4. The backlight assembly of claim 3, wherein the channel layer comprises:

a metal layer having a groove pattern, sintered metal particles, or a mesh pattern on a surface of the metal layer.

5. The backlight assembly of claim 2, wherein the receiving container further comprises:

a refrigerant which partially fills each of the subspaces, and a groove pattern, sintered metal particles, or a mesh pattern in each of the subspaces of the heat dissipation channel and on a surface of at least one of the first bottom and the second bottom, the surface being furthest away from the other bottom, wherein the groove pattern, the sintered metal particles, or the mesh pattern moves the refrigerant using a capillary pressure.

6. The backlight assembly of claim 2, wherein the receiving container further comprises:

a graphite which partially fills each of the subspaces.

7. The backlight assembly of claim 2, wherein the subspaces comprise a plurality of first subspaces and second subspaces alternately disposed, and the receiving container further comprises:

a graphite which fills each of the first subspaces;

a refrigerant which partially fills each of the second subspaces; and a channel layer in each of the second subspaces and on a surface of at least one of the first bottom and the second bottom, the surface being furthest away from the other bottom, wherein the channel layer moves the refrigerant using a capillary pressure.

8. The backlight assembly of claim 2, wherein the subspaces comprise a plurality of first subspaces and second subspaces alternately disposed, and the receiving container further comprises:

a graphite which fills each of the first subspaces; and a refrigerant which partially fills each of the second subspaces, a groove pattern, sintered metal particles, or a mesh pattern in each of the second subspaces and on a surface of at least one of the first bottom and the second bottom, the surface being furthest away from the other bottom, wherein the groove pattern, the sintered metal particles or the mesh pattern moves the refrigerant using a capillary pressure.

9. The backlight assembly of claim 2, wherein the subspaces comprise a plurality of first subspaces and second subspaces alternately disposed, the receiving container further comprises a graphite which fills each of the first subspaces, and each of the second subspaces is empty and in a vacuum state.

10. The backlight assembly of claim 2, wherein the second direction is inclined with respect to the first direction by about 45° to about 90°.

11. The backlight assembly of claim 1, wherein at least one of the first bottom and the second bottom comprises first boundary portions and second boundary portions, the first boundary portions are arranged along a first direction, extend along a second direction different from the first direction, and are protruded toward the heat dissipation channel, and the second boundary portions extend along the first direction, are partially connected to the first boundary portions, and are protruded toward the heat dissipation channel, and the heat dissipation channel has a zigzag shape circulation space, and comprises subspaces divided along the first direction by the first boundary portions and connected by the second boundary portions, the subspaces forming the zigzag shape circulation space.

12. The backlight assembly of claim 11, wherein the receiving container further comprises:

a refrigerant which partially fills the heat dissipation channel; and a circulation pump in the dissipation channel and continuously circulating the refrigerant in the circulation space.

13. The backlight assembly of claim 11, wherein the receiving container further comprises:

a refrigerant which partially fills the heat dissipation channel; and a channel layer on a surface of at least one of the first bottom and the second bottom, the surface being furthest away from the other bottom, wherein the channel layer moves the refrigerant using a capillary pressure.

14. The backlight assembly of claim 11, wherein the receiving container further comprises:

a refrigerant which partially fills the heat dissipation channel, and a groove pattern, sintered metal particles, or a mesh pattern on a surface of at least one of the first bottom and the second bottom, the surface being furthest away from the other bottom, wherein the groove pattern, the sintered metal particles or the mesh pattern moves the refrigerant using a capillary pressure.

15. The backlight assembly of claim 11, wherein the receiving container further comprises:

a graphite which partially fills the heat dissipation channel.

16. The backlight assembly of claim 1, wherein the second bottom of the second frame comprises:

a first area in which the plurality of light sources is disposed, and a second area comprising a stepped portion.

17. The backlight assembly of claim 16, further comprising:

a light guide plate which guides light provided from the light emitting module, wherein the first and second bottoms in the second areas support the light guide plate, and the plurality of light sources and the light guide plate are sequentially disposed on the first and second bottoms in the first areas.

18. The backlight assembly of claim 1, wherein the second bottom comprises an air outflow which exposes the heat dissipation channel to outside of the backlight assembly.

19. The backlight assembly of claim 1, wherein the second frame comprises:

second sidewalls which contact with the first sidewalls, and extend from the second bottom.

* * * * *